US010362419B2

(12) United States Patent
Kuhn et al.

(10) Patent No.: US 10,362,419 B2
(45) **Date of Patent: *Jul. 23, 2019**

(54) HEARING AID WITH ELECTRONICS FRAME AND ANTENNA INTEGRATED THEREIN

(71) Applicant: SIVANTOS PTE. LTD., Singapore (SG)

(72) Inventors: Johannes Kuhn, Nuremberg (DE); Oliver Nipp, Eckental (DE); Daniela Beck, Erlangen (DE); Constantine Farmakidis, Lancashire (GB)

(73) Assignee: Sivantos Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/807,626

(22) Filed: Nov. 9, 2017

(65) Prior Publication Data

US 2018/0139548 A1 May 17, 2018

(30) Foreign Application Priority Data

Nov. 14, 2016 (DE) ..... 10 2016 222 323

(51) Int. Cl.

| | |
|---|---|
| ***H04R 25/00*** | (2006.01) |
| ***H01Q 1/27*** | (2006.01) |
| ***H01Q 7/00*** | (2006.01) |
| ***H01Q 9/16*** | (2006.01) |
| *H01Q 1/38* | (2006.01) |

(52) U.S. Cl.

CPC ..... *H04R 25/65* (2013.01); *H01Q 1/273* (2013.01); *H01Q 7/00* (2013.01); *H01Q 9/16* (2013.01); *H04R 25/554* (2013.01); *H01Q 1/38* (2013.01); *H04R 2225/51* (2013.01)

(58) Field of Classification Search

CPC .. H04R 25/65; H04R 25/554; H04R 2225/51; H01Q 1/38; H01Q 7/00; H01Q 9/16

See application file for complete search history.

(56) References Cited

U.S. PATENT DOCUMENTS

| | | | | |
|---|---|---|---|---|
| 8,699,733 | B2 * | 4/2014 | Polinske | H01Q 1/243 381/315 |
| 9,571,944 | B2 | 2/2017 | Fischer et al. | |
| 9,743,198 | B2 * | 8/2017 | Bergner | H04R 25/608 |
| 2008/0272980 | A1 * | 11/2008 | Adel | H01Q 1/273 343/895 |
| 2010/0158291 | A1 | 6/2010 | Polinske et al. | |

(Continued)

FOREIGN PATENT DOCUMENTS

| | | | |
|---|---|---|---|
| WO | 2014090419 | A1 | 6/2014 |

*Primary Examiner* — Brian Ensey

(74) *Attorney, Agent, or Firm* — Laurence A. Greenberg; Werner H. Stemer; Ralph E. Locher

(57) ABSTRACT

A hearing aid contains a housing and, inserted in the housing, is a frame for receiving electrical or electronic assemblies. The assemblies received in the frame contains a transmitting and/or receiving unit for electro-magnetic waves. The hearing aid moreover has an antenna assigned to the transmitting and/or receiving unit, which antenna is configured as an integral part of the frame, as a stamped/bent part or as inlay part made of metal. The antenna contains two parts which are each configured as open loops with two ends, wherein the two loop-shaped parts of the antenna are electrically shorted to each other by a respective end.

14 Claims, 8 Drawing Sheets

(56) References Cited

U.S. PATENT DOCUMENTS

| | | | |
|---|---|---|---|
| 2012/0087506 | A1 | 4/2012 | Oezden |
| 2014/0010394 | A1 | 1/2014 | Kvist |
| 2015/0281859 | A1 | 10/2015 | Fischer et al. |
| 2016/0241973 | A1 | 8/2016 | Murray et al. |

* cited by examiner

HEARING AID WITH ELECTRONICS FRAME AND ANTENNA INTEGRATED THEREIN

CROSS-REFERENCE TO RELATED APPLICATION

This application claims the benefit, under 35 U.S.C. § 119, of German patent application DE 10 2016 222 323.2, filed Nov. 14, 2016; the prior application is herewith incorporated by reference in its entirety.

BACKGROUND OF THE INVENTION

Field of the Invention

The invention relates to a hearing aid with a housing and, inserted in the latter, an (electronics) frame which carries electrical or electronic components of the hearing aid, and with an antenna which is configured to transmit and/or receive electromagnetic waves (in particular radio signals, also called RF signals). Such a hearing aid is known from international patent disclosure WO 2014/090419 A1, corresponding to U.S. Pat. No. 9,571,944.

"Hearing aids" include portable hearing devices that serve to assist those with hearing impairments. In order to satisfy the numerous individual needs, various structural types of hearing aids are made available, such as behind-the-ear hearing devices (BTE), hearing aids with an external receiver (RIC: receiver-in-canal), and in-the-ear hearing devices (ITE), e.g. also concha hearing devices or canal hearing devices (ITE, CIC). The listed examples of hearing aids are worn on the outer ear or in the auditory canal. In addition, however, bone conduction hearing aids, implantable or vibrotactile hearing aids, are also available on the market. In these, the damaged hearing is stimulated either mechanically or electrically. Such hearing aids are also designated as "hearing devices".

In addition to the classic hearing aids described above, hearing aids have also recently been developed that assist people with normal hearing. Such hearing aids are also referred to as "Personal Sound Amplification Products" or "Personal Sound Amplification Devices" (abbreviated to "PSAD"). These hearing aids are not provided to compensate for hearing losses. Instead, such hearing aids are used precisely to assist and improve normal human hearing capacity in specific hearing situations, e.g. to assist hunters out on the hunt, or in order to assist in the observation of animals, to be better able to perceive animal noises and other sounds generated by animals, for sports reporters in order to permit improved speaking and/or speech understanding under difficult conditions, for musicians, in order to reduce the stress on their hearing, and so on.

In principle, the essential components of hearing aids are an input transducer, an amplifier and an output transducer. The input transducer is normally an acoustic-electric transducer, e.g. a microphone, and/or an electromagnetic receiver, e.g. an induction coil. The output transducer is generally realized as an electroacoustic transducer, e.g. a miniature loudspeaker (receiver), or an electromechanical transducer, e.g. a bone-conduction receiver. The amplifier is usually integrated in a signal-processing device.

Modern hearing aids are often equipped with transmitting and/or receiving units that permit wireless communication with other electronic devices, in particular with other hearing aids (e.g. in order to form a binaural hearing aid system), remote controls, programming devices or cell phones. The wireless communication is often effected by means of electromagnetic waves in the radiofrequency range, e.g. using Bluetooth technology at 2.4 GHz.

A problem with hearing aids lies in the realization of the (RF) antennas needed for them, since standard antenna designs cannot easily be used on account of the free-space wavelength (corresponding to the abovementioned frequency range) of more than 10 cm and on account of the electrically small volume of conventional hearing aids. This problem is becoming increasingly important as the miniaturization of hearing aids gathers pace.

In the hearing aid known from international patent disclosure WO 2014/090419 A1, the antenna is formed by a conductive structure which is an integral part of the (electronics) frame of the hearing aid. This allows the antenna to be accommodated in a space-saving manner in the housing of the hearing aid. Moreover, the antenna can be installed with the frame in a large number of different housings, without the antenna design always having to be reconfigured.

SUMMARY OF THE INVENTION

The object of the invention is to improve the antenna design known from international patent disclosure WO 2014/090419 A1.

The hearing aid according to the invention contains a housing and, inserted in the housing, an (electronics) frame for receiving electrical and/or electronic assemblies. The assemblies received in the frame contain a transmitting and/or receiving unit for electromagnetic waves, in particular radio waves in the MHz or GHz range (e.g. 2.4 GHz). The hearing aid moreover has an antenna which is assigned to the transmitting and/or receiving unit and which is configured as an integral part of the frame. Integral part is to be understood here in particular as meaning that the antenna or a structure partially or completely forming the antenna cannot be released from the frame without destruction and/or is substantially part of the outer shape of the frame, i.e. does not protrude much therefrom, wherein the frame is made of a different, non-conductive material, in particular a plastic. In an alternative embodiment of the invention, the antenna is configured as a stamped/bent part (connected to the frame) or as an inlay part (connected to the frame) made of metal.

According to the invention, the antenna contains two parts which are each configured as an open loop, wherein these two loop-shaped parts of the antenna, hereinafter abbreviated to "antenna loops", are electrically shorted to each other by one of the two (loop) ends. At least one of the two other ends of the two antenna loops is in contact with the transmitting and/or receiving unit. In particular, the antenna is designed as a folded dipole antenna. The ends of both antenna loops are preferably arranged at the same longitudinal end of the frame.

Through the integration of the antenna on the frame, in combination with the double-loop shape of the antenna, it is considerably easier to achieve the antenna length that is necessary for effective transmitting and/or receiving characteristics of the antenna. Each antenna loop then preferably has a length which corresponds with good approximation to a quarter or an eighth of the wavelength of the radio waves for which the transmitting and/or receiving unit is designed.

In a preferred embodiment of the invention, the two antenna loops are connected to each other electrically conductively, i.e. shorted, via at least one bridge. Such a bridge or a part of such a bridge is formed for example by at least one electrical conductor track which completely or at least partially bridges the distance between the short-circuit ends of the antenna loops and which is therefore referred to below as a "bridging conductor". Like the entire antenna, the or each bridging conductor is configured as an integral part of the frame, stamped/bent part or inlay part.

In one expedient configuration, the frame is formed by two frame halves, each one of the two antenna loops being arranged respectively on one of the two frame halves. The two antenna loops are preferably configured symmetrically to each other with respect to a separating plane that separates the frame halves. The symmetrical configuration of the antenna advantageously facilitates a side-independent use of the hearing aid. This feature in other words allows one and the same housing, including the frame and the components received in the latter, to be used both for use on the left ear and also for use on the right ear.

However, in differing embodiments of the invention, the two antenna loops can also be formed asymmetrically with respect to each other. The asymmetric configuration of the two antenna loops is preferably always chosen when a symmetrical configuration of the antenna loops would lead to stronger electromagnetic interference between the antenna and the other electrical or electronic assemblies in or on the frame. The asymmetry between the two antenna loops is preferably slight. The antenna loops are in particular made as symmetrical as possible while avoiding the interference.

In embodiments of the invention with a two-part frame, the two antenna loops in a preferred embodiment of the invention are shorted to each other via two bridging conductors which, as has been mentioned above, are configured as integral parts of the frame, with one of the bridging conductors being arranged respectively on one of the two frame halves. To produce an electrical cross-connection between the antenna loops, the two bridging conductors are soldered to each other. In this case, a bridge connecting the two antenna loops electrically to each other is then formed by the two bridging conductors and a soldered connection or a solder point. The antenna, on the other hand, is typically formed by the two antenna loops and the bridge or bridges connecting the two antenna loops.

In an expedient embodiment, at least one of the two bridging conductors is arranged on a collar structure of the associated frame half which extends over the entire width of the frame as far as the lateral surface of the other frame half. The two bridging conductors are in this case soldered to each other on this surface of the other frame half. This configuration of the frame halves and of the bridging conductors allows the bridging conductors to be laterally soldered in a manner that is advantageous from the point of view of process engineering (in particular through ease of access), i.e. soldered on one side surface of the frame.

It is also of advantage if the two antenna loops are each arranged on a flank or in a side region of the frame. Here, side region or flank designates a side of the frame that connects an upper face and an underside of the frame. The corresponding designation of the sides of the frame with upper face, underside and flank relates to the intended orientation of the hearing aid relative to a wearer or user of the hearing aid while wearing the corresponding hearing aid. The underside of the frame then typically points in the direction of the trunk of the user or wearer, and one of the two flanks or one of the side regions points in the direction of the head, while the other of the two flanks or the other of the two side regions is directed away from the head. The resulting relative arrangement and/or orientation of the two antenna loops relative to the user or wearer of the hearing aid is relevant as regards the radiating characteristics of the antenna during transmission.

Particularly when the two antenna loops are arranged in the region of the two flanks of the frame, it is moreover of advantage if, in order to form a bridge, a conductor structure, for example a conductor track or an aforementioned bridging conductor, is routed over the upper face of the frame. The conductor structure is then configured, for example, as a continuous conductor track or as a continuous conductor strip and extends from one of the ends of one antenna loop to one of the ends of the other antenna loop.

It is furthermore advantageous for the embodiment and the arrangement of the antenna and the conductor structures thereof if the corresponding conductor structures are positioned as far away as possible from the other metallic elements, such as for example, electronic components arranged in or on the frame. In this way, undesired interactions maybe reduced or avoided.

If the frame is configured in one part, or if the conductor structures partially or completely forming the antenna are realized or formed after a multi-part frame has been assembled, the conductor structures can be configured in such an way that no visible or clearly defined transition can be discerned between the antenna loops and the conductor structure that forms the bridge and connects the two ends of the two antenna loops. In this case, the position of the ends of the two antenna loops is then virtually defined by the geometry of the frame. That is to say, the antenna loops in such a case extend only over the flanks of the frame, whereas the conductor structure forming the bridge extends only over the upper face of the frame.

However, an above-described two-part configuration of the frame is preferred. The two-part configuration is preferably such that the separating plane separating the two frame halves divides the upper face and the underside of the frame in two, but not the flanks. In this case, in order to form a bridge on both frame halves, a conductor structure, in particular a conductor track or a bridging conductor, is preferably formed which extends from the end of the antenna loop, positioned on the corresponding frame half, as far as the separating plane, specifically in such a way that the corresponding two conductor structures or bridging conductors of the two frame halves meet each other head on at the separating plane or lie opposite each other in a manner separated by the separating plane. In this case, the conductor structures partially or completely forming the antenna can be mounted on the individual frame parts before the frame is assembled.

After the frame has been assembled, i.e. after the individual frame parts have been joined together, the bridge is then completed, for example by a contact, or by the fact that the conductor structures or bridging conductors lying opposite each other or abutting each other in the region of the separating plane are soldered to each other, in particular by application of a solder point, or electrically conductively connected to each other in another way.

Particularly if the application of a solder point or a connection via an additional connection element of relevant volume is provided, it is moreover of advantage if a depression is formed on the frame in the region of the separating plane and in the region in which the conductor structures or the bridging conductors meet at the separating plane. In this way, a produced solder point or another connection element completing the bridge is arranged in a recessed state and thus, for example, protected from damage.

In one embodiment variant, a bridge of this kind spanning the upper face is arranged in the region of the front face or front of the frame, i.e. the side of the frame that is directed toward the wearer's face when the hearing aid is being worn.

In an advantageous refinement, the two antenna loops are in addition electrically conductively connected to each other via a second bridge, in particular a second bridge spaced apart from the first one. In this case, the second bridge is preferably likewise routed over the upper face of the frame. If the frame is in two parts in the manner described above, then, in the case of the second bridge too, conductor structures or bridging conductors are preferably also arranged on both frame halves and are then electrically conductively connected to each other in the region of the separating plane, for example by a solder point. Here too, it is again preferable for a depression to be arranged on the frame in this region in order for a corresponding connection element, e.g. a solder point, to be arranged in a recessed position.

Through the formation of a second bridge, a conductor structure is realized in which the two bridges, together with conductors of the two antenna loops connecting the two bridges, form a conductor ring, i.e. a closed annular structure made of a conductive material. In addition, this has a favorable effect on the radiating characteristics of the antenna during transmission.

If two bridges are now provided, then, according to an expedient embodiment variant, one bridge is arranged in the region of the front of the frame and routed over the upper face of the frame, and one bridge is arranged in the region of the rear face of the frame lying opposite the front and is routed over the upper face of the frame.

Particularly if two bridges are provided, it is moreover preferable that one of the two bridges is positioned in a region above the position of the battery or of the battery compartment of the hearing aid.

In this case, the positions of the linking points or connecting points of the bridges are also of particular importance, that is, the positions along the two antenna loops, to which the bridges connect or at which the bridges are connected to the two antenna loops/ The latter are expediently chosen such that an advantageous, relative phase position is the result. In so doing, it is the aim to ensure that the partial waves radiated away from the conductor structures of the antenna overlap one another, that is, particularly in a structural sense.

According to an advantageous refinement of the invention, the frame is made from a non-conductive material, in particular a plastic, that has a higher permittivity than the material of the housing. The frame material of the hearing aid according to the invention also has in particular a higher permittivity than materials that are generally used for electronics frames of conventional hearing aids. In particular, the frame material of the hearing aid according to the invention has a relative permittivity of at least 3.8, preferably at least 4.5. It has been found that the increased permittivity of the frame material as a result of dielectric interaction with the electromagnetic field that is produced or received by the antenna allows significant shortening of the antenna length at given transmitting/receiving characteristics. This in turn represents a considerable advantage for accommodating the antenna on the frame.

For the integration of the antenna or parts of the antenna in the frame, the surface of the frame is preferably first of all structured in such a way that, when the conductive layer is applied, the latter is applied only as per the structuring. This is effected, for example, by means of laser direct structuring (LDS). The surface of the frame is in this case treated with a laser in such a way that a conductor track deposits only on the treated locations in an electroplating bath.

In another embodiment of the method, a conductive layer is first of all applied to the surface of the frame, after which the conductive layer is structured. In this case, the conductive layer is applied, for example, by bonding, sputtering or some other means.

In a further alternative in this context, the antenna is printed onto the frame or parts of the antenna are printed onto the frame.

Other features which are considered as characteristic for the invention are set forth in the appended claims.

Although the invention is illustrated and described herein as embodied in a hearing aid with electronics frame and an antenna integrated therein, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts that correspond to each other are always provided with the same reference signs in all of the figures.

Figure 1:
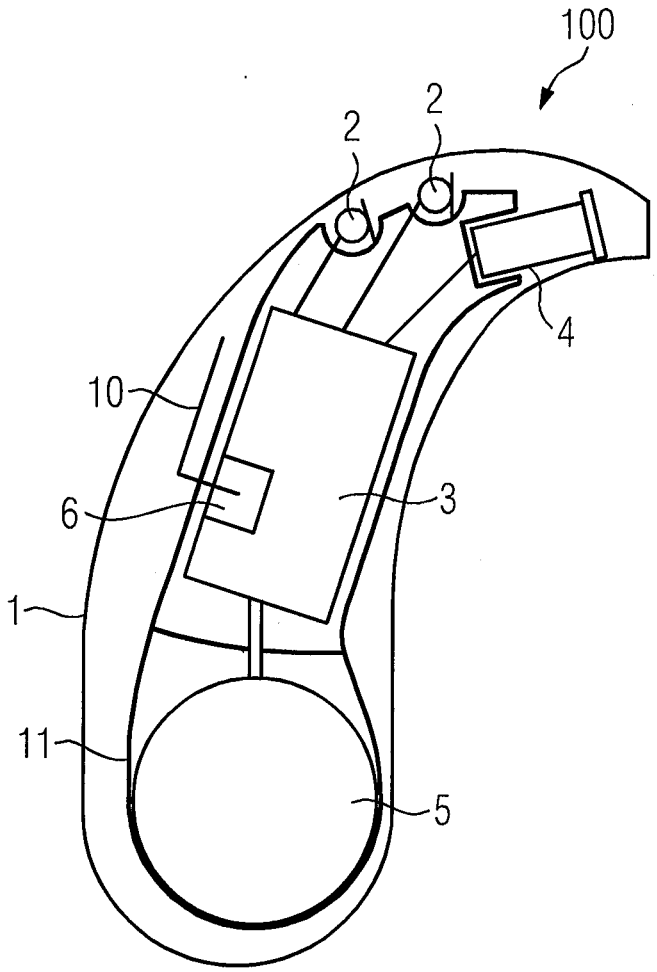
FIG. 1 is a schematic view of a hearing aid according to the invention.
Figure 2:
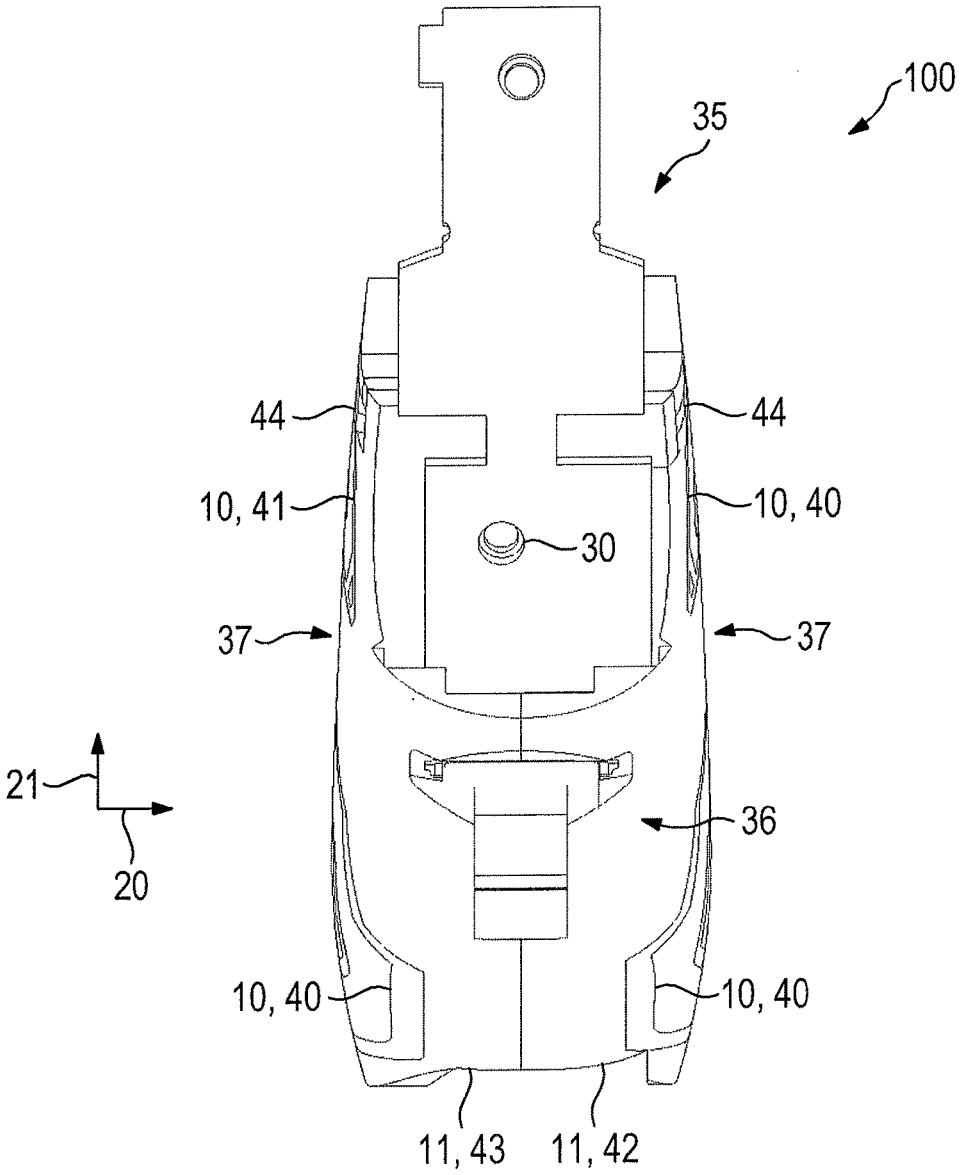
FIG. 2 is an illustration showing a first concrete embodiment of the hearing aid.
Figure 3:
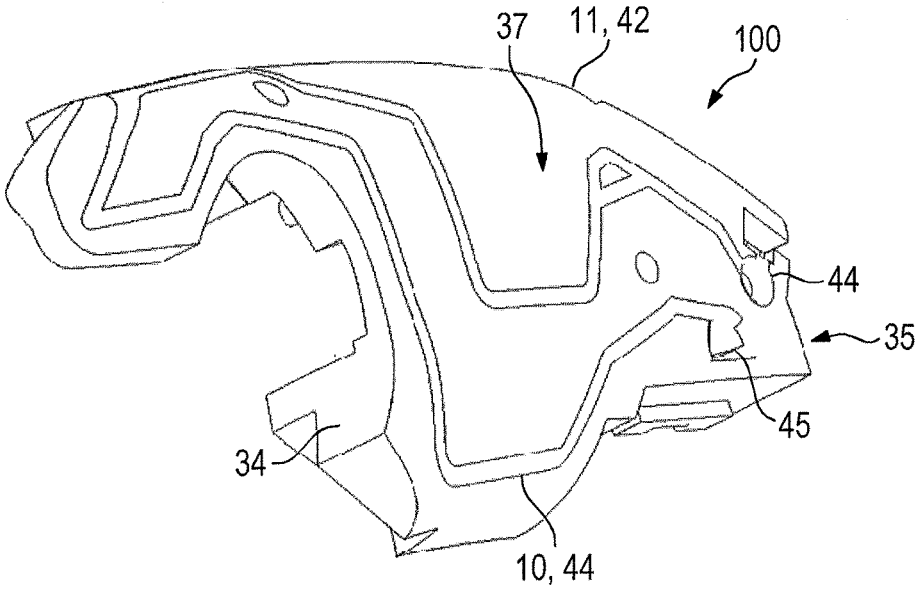
FIG. 3 is a perspective view of a half of a frame of the hearing aid according to FIG. 2.

Referring now to the figures of the drawings in detail and first, particularly to FIG. 1 thereof, there is shown the principal elements of a hearing aid 100, without reproducing the true positions, connections or shapes of the elements.

The hearing aid 100 shown in FIG. 1 is a behind-the-ear hearing aid 100. However, the invention is also conceivable for in-the-ear hearing aids, in which case there is then a different arrangement of the components shown.

The hearing aid 100 has a housing 1 which is made of plastic and in which a frame 11 is inserted. The frame 11 is an injection-molded plastics part. The frame 11 serves generally to hold electrical and electronic assemblies of the hearing aid 100 and to fix these assemblies in defined positions relative to one another. Specifically, one or more microphones 2 for receiving sound (i.e. acoustic signals) from the environment are arranged in the frame 11. For this purpose, a printed circuit board (PCB) carrying at least some of the electrical or electronic components is in particular folded into the frame 11.

The microphones 2 are acoustic-electric transducers for converting the sound into audio signals. A signal-processing device 3, which is likewise integrated in the housing 1, processes these audio signals. The output signal of the signal-processing device 3 is transmitted to a loudspeaker or receiver 4, which emits an acoustic signal. The sound is transmitted to the eardrum of the device wearer, possibly via a sound tube that is fixed in the auditory canal with an ear mold. The power supply for the hearing aid and particularly for the signal-processing device 3 is provided by a battery 5 that is likewise integrated in the housing 1. The signal-processing device 3, the receiver 4 and the battery 5 are likewise arranged in the frame 11, such that the frame with the components arranged therein can easily be removed from the housing, for example in order to be able to exchange the housing 1.

The signal-processing device 3 according to the invention is also configured to process electromagnetic waves. The signal-processing device 3 has a transmitting and receiving device 6 for producing and detecting electromagnetic waves and/or for decoding. The transmitting and receiving device 6 is electrically connected to an antenna 10 in order to transmit and receive electromagnetic waves.

The antenna 10 is configured as an integral part of the frame 11, namely as a conductive structure integrated in the frame 11. The antenna 10 is mounted directly on the frame 11. It is not spaced apart from the surface and cannot be released from the frame 11 without destruction.

The antenna 10 is mounted on the frame 11 in particular using MID technology. This is accomplished in particular by using laser direct structuring (LDS). In an alternative embodiment, the antenna 10 is printed directly onto the frame 11. The conductor structures put onto the surface of the frame 11 are then optionally electrically insulated and protected against damage by a protective lacquer or coating.

FIGS. 2 to 6 show a first embodiment of the frame 11 with the antenna 10 integrated therein. An opening 30, below which the microphone 2 (or one of several microphones 2) is arranged, is provided on an upper face 36 of the frame 11 as seen in the view according to FIG. 2. Recesses in the frame 11, which are not shown explicitly, serve to accommodate the receiver 4 and the transmitting and receiving unit 6. Moreover, the frame 11 forms a battery compartment 34 (see FIG. 3) for accommodating the battery 5.

When the hearing aid 100 is operated as intended, a sound tube is attached to a tip or front 35 of the frame 11 and allows the sound generated by the receiver 4 to be conveyed to an ear mold insertable into the auditory canal of a user. The sound tube and the ear mold are not shown in FIG. 2. When the hearing aid is being worn as intended on the ear, the frame 11 is oriented in its longitudinal direction 21 with the tip of front 35 facing forward in the viewing direction of the wearer. A transverse direction 20 of the frame 11 is perpendicular to the viewing direction of the wearer and more or less parallel to the connecting line between the ears of the wearer. Parts of the antenna 10 are arranged on the lateral surfaces or flanks 37 of the frame 11.

The frame 11 is divided into two frame halves 42 and 43 lengthwise (i.e. perpendicular to the transverse direction 20) along a dividing plane or separating plane 38. After the insertion of the assemblies accommodated therein, the frame halves 42 and 43 are in this case connected by clipping, screwing, adhesive bonding and/or by retaining pins.

In the embodiment of the hearing aid 100 shown in FIGS. 2 to 6, the antenna 10 has two parts which each have the shape of an open loop and are therefore designated below as antenna loops 40 and 41. The antenna loop 40 is arranged on the frame half 42, while the antenna loop 41 is arranged on the other frame half 43.

The two antenna loops 40 and 41, seen transversely with respect to the dividing plane or separating plane 38 of the frame 11, run parallel to each other and are thus aligned with each other. The antenna 10 therefore has mirror symmetry with respect to the dividing plane or separating plane 38 of the frame 11.

Figure 4:
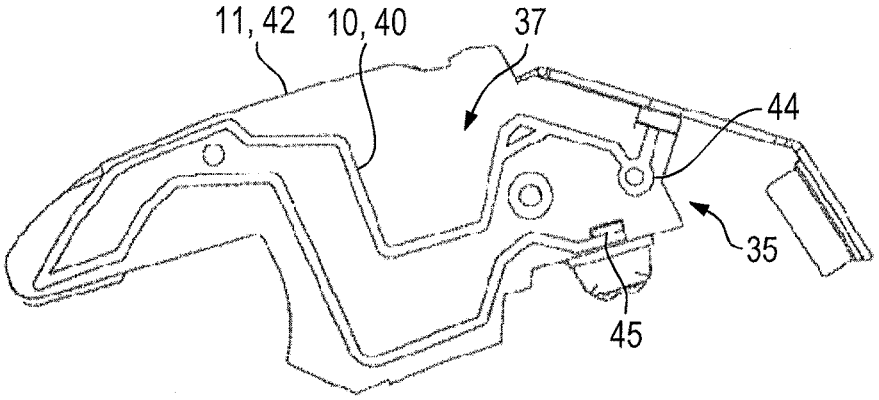
FIG. 4 is a side view of the frame half according to FIG. 3.

Each of the two antenna loops 40 and 41 has two respective ends 44 and 45 (cf. FIG. 4). In this case, both ends 44 and 45 are each arranged at the same longitudinal end of the frame 11 (namely at the tip or front 35). The two ends 44 of the two antenna loops 40 and 41 are electrically shorted to each other via an electrical cross-connection or bridge 46 that also spans the separation of the two frame halves 42, 43. The two other ends 45 are in contact with the transmitting and receiving device 6.

Figure 5:
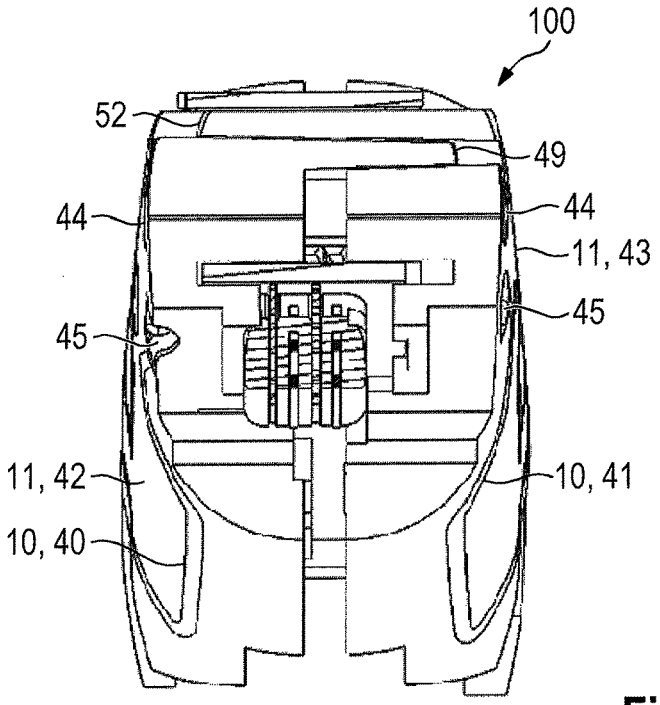
FIG. 5 is an illustration showing the slightly opened frame of the hearing aid according to FIG. 2, looking toward the tip thereof.
Figure 6:
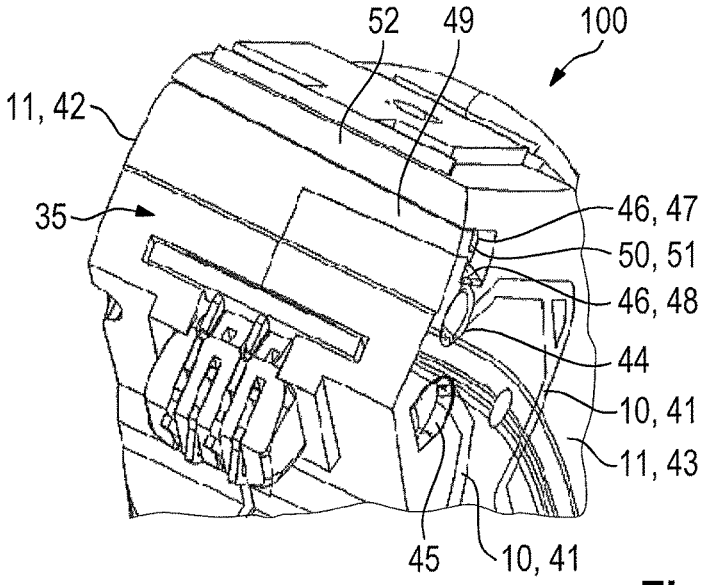
FIG. 6 is a perspective view of the tip of the frame of the hearing aid according to FIG. 3.

In the embodiment shown in FIGS. 2 to 6, the cross-connection or bridge 46 is formed at least partly by conductor tracks, which are referred to below as bridging conductors 47 and 48 (cf. FIG. 6), and which are likewise mounted directly on the frame halves 42 and 43 of the frame 11 using MID technology (particularly by means of LDS). The bridging conductor 47 connected to the antenna loop 40 is in this case mounted on a collar structure 49 of the frame half 42 that extends over the entire width of the frame 11 as far as the opposite lateral surface of the other frame half 43. This can be seen particularly in FIG. 6, which shows the frame 11 in the closed state with the frame halves 42 and 43 fully joined together. By contrast, FIG. 5 shows the frame 11 in a partially opened state in which the frame halves 42 and 43 are drawn slightly apart from each other. The bridging conductor 48 connected to the antenna loop 41 is mounted on the frame half 43 such that it meets the bridging conductor 47 at the end of the collar structure 49 at a meeting point 50. At this meeting point 50, bridging conductors 47 and 49 are electrically connected to each other by a solder joint 51. The meeting point 50 situated on the lateral surface of the frame half 43 allows the bridging conductors 47 and 49 to be soldered laterally in a manner that is advantageous in terms of process engineering.

The frame half 43 is also provided with a collar structure 52 that reaches as far as the lateral surface of the other frame half 42. The collar structures 49 and 52 engage in a toothed manner into the respective other frame half 43 or 42. The collar structures 49 and 52 therefore bring about mechanical stabilization of the frame 11. This stability is advantageous particularly for stabilizing the solder joint 51 between the bridging conductors 47, 48. The bridging conductor 47 runs between the collar structures 49 and 52. It is protected thereby and routed at a distance from other electrical or electronic components, such that electromagnetic interference between the antenna 10 and the other electrical or electronic components is avoided.

The distribution of the antenna 10 over both frame halves 42 and 43 firstly facilitates the provision of the required antenna length. Secondly, the symmetrical formation of the antenna 10 with respect to the two frame halves 42 and 43 advantageously facilitates side-independent use of the hearing aid 100. In other words, this feature allows one and the same housing 1, including the frame 11 and the components received therein, to be used both for use on the left ear and for use on the right ear.

The frame 11 is produced from a plastic that has a much higher permittivity than the housing 1. It has been found that the increased permittivity of the frame material as a result of dielectric interaction with the electromagnetic field that is produced and received by the antenna 10 allows significant shortening of the antenna length.

Figure 7:
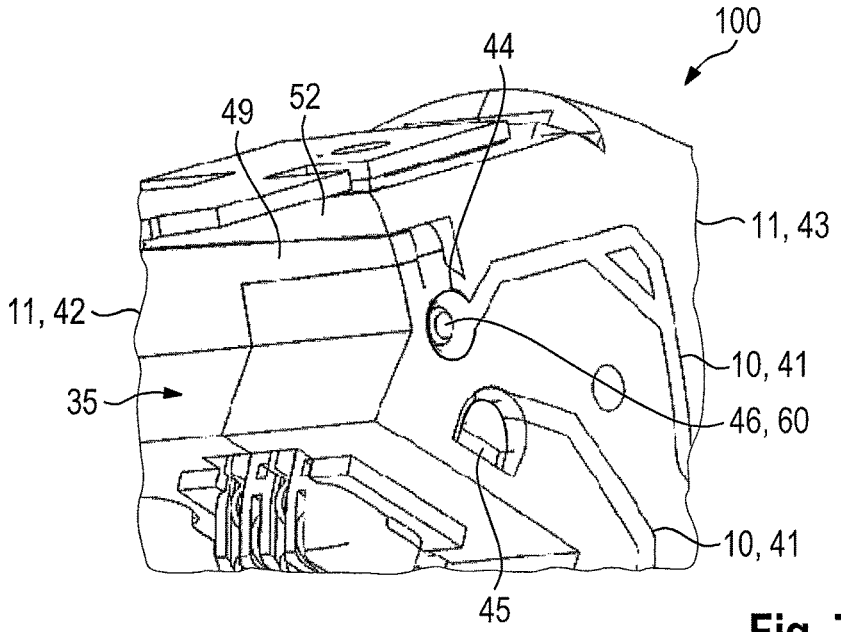
FIG. 7 is a perspective view of a second embodiment of the hearing aid.
Figure 8:
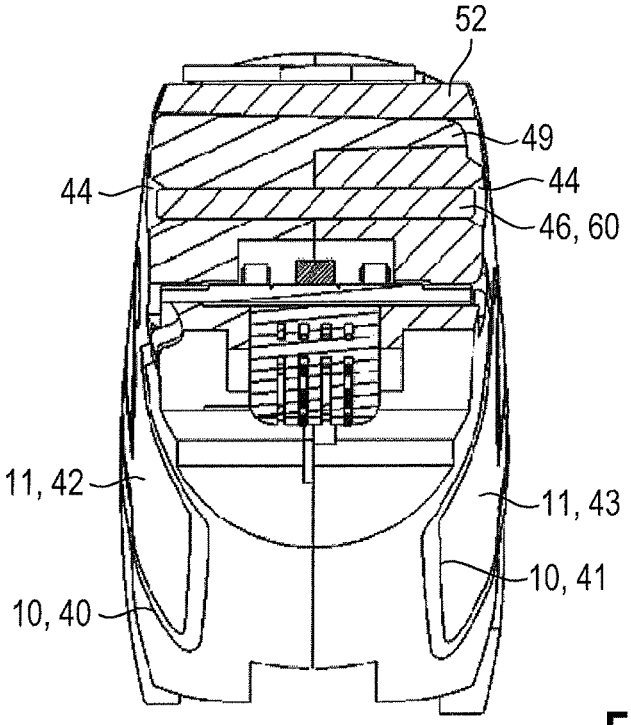
FIG. 8 is a cross-section view of the second embodiment of the hearing aid.

FIGS. 7 and 8 show a variant or second embodiment of the above-described hearing aid 100. The variant according to FIGS. 7 and 8 differs from the embodiment of the hearing aid 100 described above in that the bridging conductors 47 and 48 and the solder joint 51 are absent. Instead, the variant shown in FIGS. 7 and 8 is provided with an electrically conductive retaining pin 60 that passes through the two frame halves 42 and 43, such that the ends 44 of the two antenna loops 40 and 41 are electrically shorted to each other. The retaining pin 60 is furthermore also used for mechanically fixing the two frame halves 42 and 43 to each other.

Figure 9:
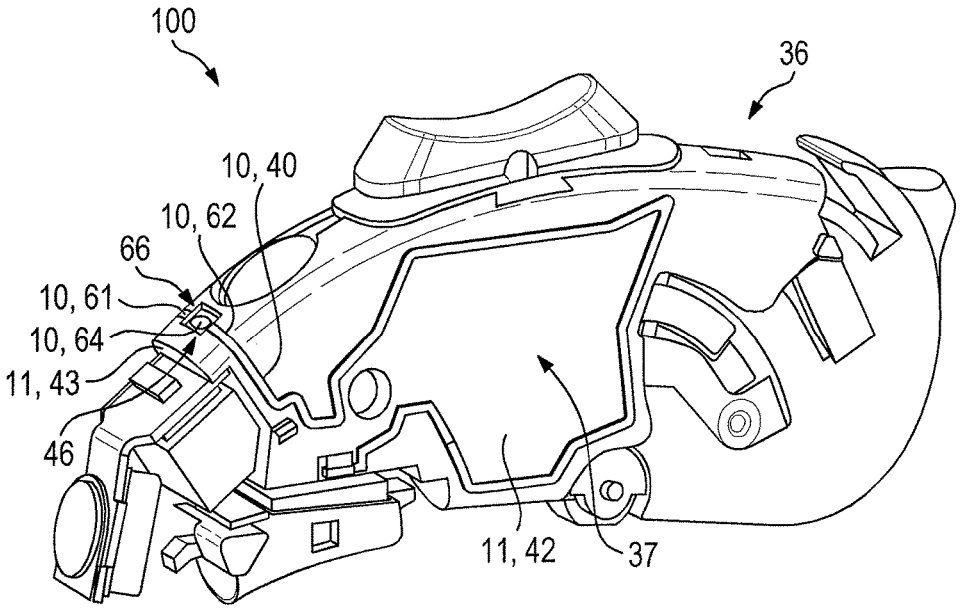
FIG. 9 is a perspective view of a third embodiment of the hearing aid with an antenna.

A further embodiment variant of the hearing aid 100 is shown in FIG. 9. The main difference here from the above-described embodiment variants lies in the design of the bridge 46 with which the two antenna loops 40, 41 are shorted. In the embodiment according to FIG. 9, the whole bridge 46 is formed externally on the frame 11 and routed over the upper face 36 of the frame 11.

Figure 10:
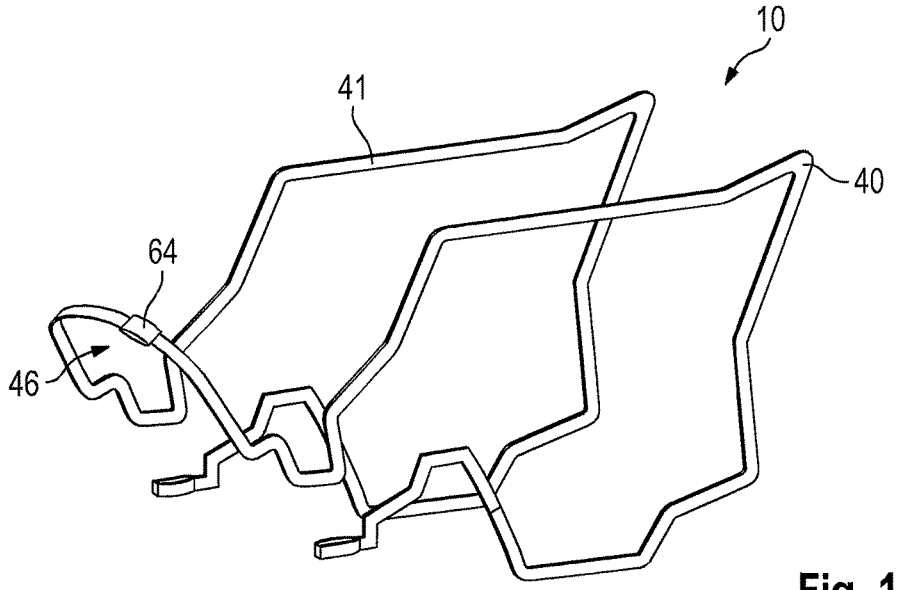
FIG. 10 is a perspective view of the antenna of the third embodiment of the hearing aid.

The frame 11 is again configured in two parts, and an antenna loop 40, 41 is positioned on each frame half 42, 43, in each case in the region of the flank 37. The antenna loops 40, 41 terminating at the transition to the upper face 36 of the frame 11 are here continued by external bridging conductors 61, 62 as far as the separating plane 38 and meet each other at the separating plane 38 or terminate here opposite each other. To form an electrical connection between these bridging conductors 61, 62, the latter are preferably connected electrically conductively to each other by means of a connection element, for example a solder point 64. The corresponding solder point 64 or the corresponding connection element is more preferably recessed in a depression 66 in the frame 11. In this illustrative embodiment, the antenna 10 is then formed only by conductor structures or conductor elements positioned externally on the frame 11, as is also depicted in FIG. 10. Only the antenna 10 is shown in this view, as the frame 11 has been faded out.

Figure 11:
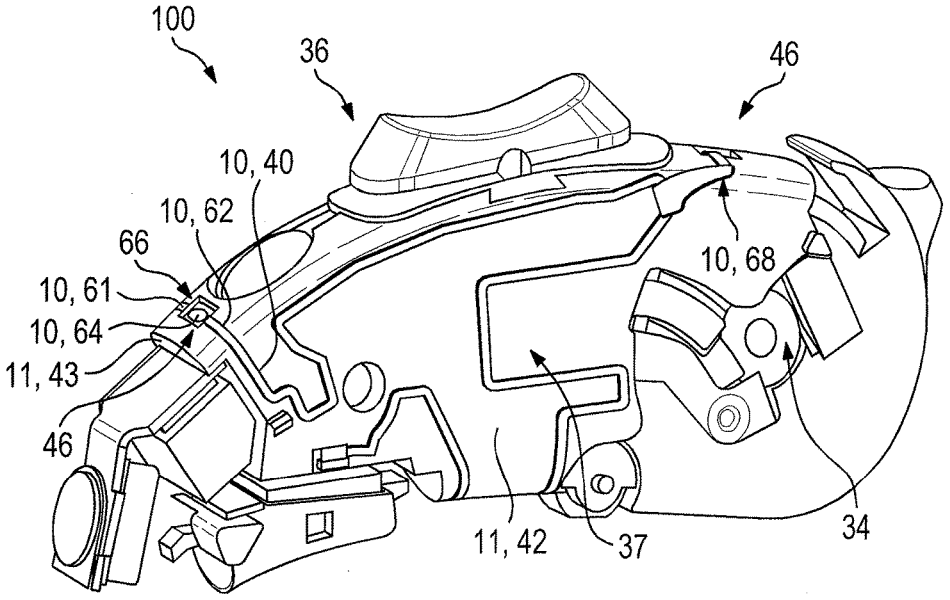
FIG. 11 is a perspective view of a fourth embodiment of the hearing aid with a frame and an antenna.
Figure 12:
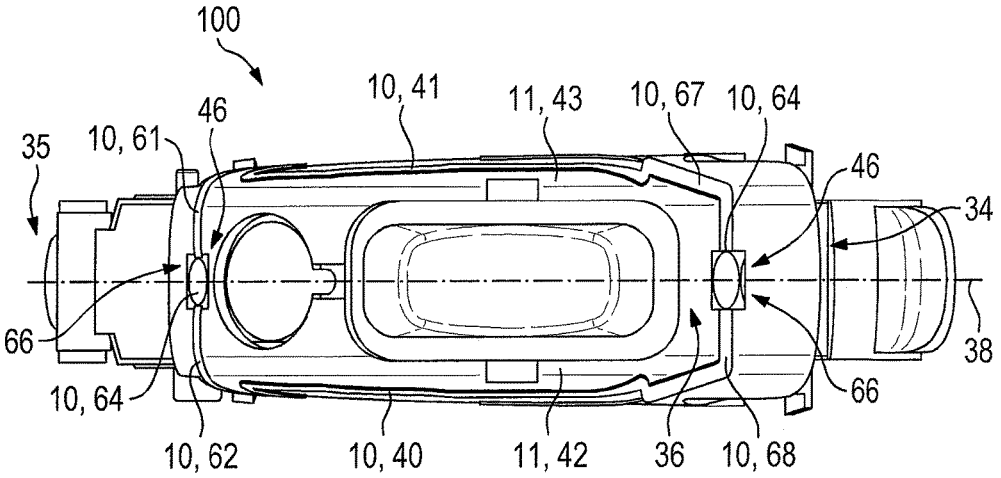
FIG. 12 is a plan view of a fourth embodiment of the hearing aid.
Figure 13:
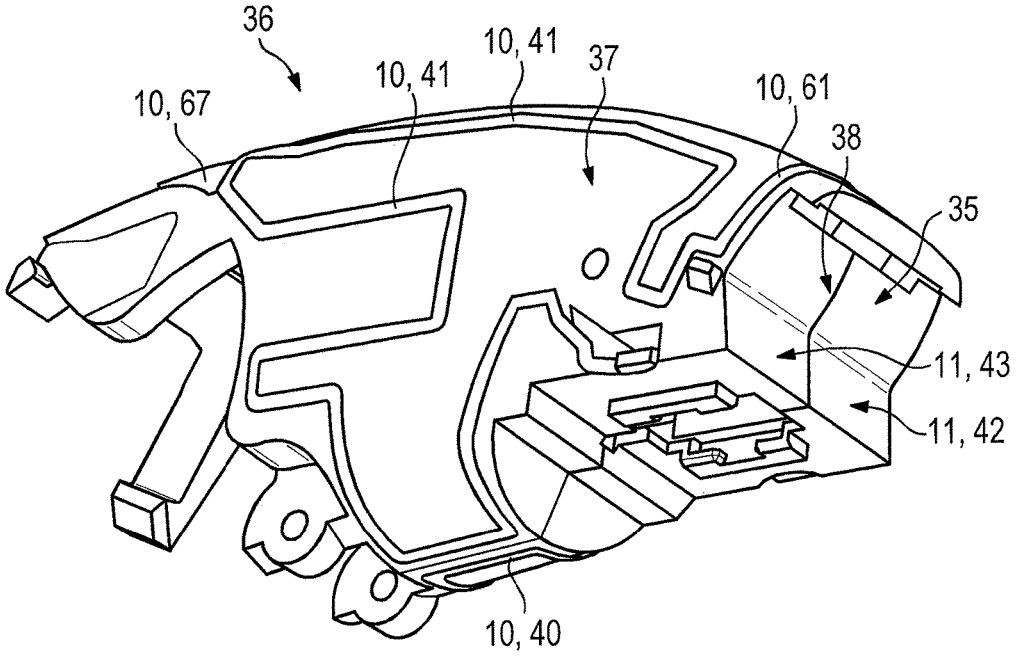
FIG. 13 is a perspective view of the frame and the antenna of the fourth embodiment of the hearing aid.

An advantageous development of the hearing aid 100 according to FIG. 9 is shown in FIG. 11 to FIG. 13. Here, a second bridge 46 is additionally formed which in turn connects the antenna loops 40, 41 electrically conductively to each other. One of the two bridges 46 is in this case arranged in the region of the tip or front 35 of the frame 11 and routed over the upper face 36 of the frame 11, and the other of the two bridges 46 is positioned in the region of the rear face of the frame 11 lying opposite the front 35 and likewise routed over the upper face 36 of the frame 11. The second bridge 46 is in this case also formed by two bridging conductors 67, 68 which are connected electrically conductively to each other, in the region of the separating plane 38, via a solder point 64 arranged in a depression 66 or via another connection element.

In further variants (not shown) according to the invention for the hearing aid 100, the two antenna loops 40, 41 are formed asymmetrically in relation to each other. The asymmetric form of the two antenna loops 40, 41 is preferably chosen when a symmetrical form of the antenna loops 40, 41 would lead to greater electromagnetic interference between the antenna 10 and the other electrical or electronic components in or on the frame 11. The asymmetry between the two antenna loops 40 and 41 is preferably small in this case. The antenna loops 40, 41 are made as symmetrical as possible particularly in order to avoid the interference.

The invention will be particularly clear from the illustrative embodiments described above. However, it is not limited to these illustrative embodiments. Instead, many other embodiments of the invention may be derived from the claims and from the above description.

The following is a summary list of reference numerals and the corresponding structure used in the above description of the invention:

1 housing
2 microphone
3 signal-processing device
4 receiver
5 battery
6 transmitting and receiving device
10 antenna
11 frame
20 transverse direction
21 longitudinal direction
30 opening
34 battery compartment
35 front
36 upper face
37 flank
38 separating plane
40 antenna loop
41 antenna loop
42 frame half
43 frame half
44 end
45 end
46 bridge
47 bridging conductor
48 bridging conductor
49 collar structure
50 meeting point
51 solder joint
52 collar structure
60 retaining pin
61 bridging conductor
62 bridging conductor
64 solder point
66 depression
67 bridging conductor
68 bridging conductor
100 hearing aid

The invention claimed is:

1. A hearing aid, comprising:

a housing;

a transmitting and/or receiving unit;

a frame inserted in said housing for receiving electrical or electronic assemblies including said transmitting and/or receiving unit for electromagnetic waves; and an antenna configured as an integral part of said frame, as a stamped/bent part or as inlay part made of metal, said antenna having two loop-shaped parts which are each configured as open loops with two ends, said two loop-shaped parts of said antenna are electrically shorted to each other by a respective one of said ends.

2. The hearing aid according to claim 1, wherein said ends of both of said two loop-shaped parts of said antenna are disposed at a same longitudinal end of said frame.

3. The hearing aid according to claim 1, wherein said antenna has a bridge where said two loop-shaped parts of said the antenna are shorted to each other via said bridge, said bridge configured as an integral part of said frame.

4. The hearing aid according to claim 3, wherein said frame has a battery holder and said bridge is formed in a region of said battery holder.

5. The hearing aid according to claim 3, wherein said bridge is formed by conductive structures positioned externally on said frame.

6. The hearing aid according to claim 3, wherein:

said frame having two mutually opposite flanks and an upper face; and said two loop-shaped parts of said antenna are positioned on said two mutually opposite flanks of said frame, and in that said bridge is routed over said upper face on said frame.

7. The hearing aid according to claim 3, wherein said antenna has a further bridge, said two loop-shaped parts of said antenna are additionally shorted to each other via said further bridge, said bridge and said further bridge are disposed spatially apart from each other.

8. The hearing aid according to claim 7, wherein one of said bridge and said further bridge are disposed in a region of a front of said frame, and one of said bridges is disposed in a region of a rear face of said frame lying opposite said front.

9. The hearing aid according to claim 1, wherein said antenna has at least one bridging conductor and said two loop-shaped parts of said antenna are shorted to each other via said at least one bridging conductor, said bridging conductor is configured as an integral part of said frame.

10. The hearing aid according to claim 1, wherein said frame has two frame halves, one of said two loop-shaped parts of said antenna being respectively disposed on one of said two frame halves.

11. The hearing aid according to claim 10, wherein said two loop-shaped parts of said antenna are formed symmetrically to each other with respect to a separating plane that separates said two frame halves.

12. The hearing aid according to claim 10, wherein said antenna has two bridging conductors and said two loop-shaped parts of said antenna are shorted to each other via said two bridging conductors, said bridging conductors are configured as integral parts of said frame, with in each case one of said bridging conductors being respectively disposed on one of said two frame halves, and with said two bridging conductors being soldered to each other.

13. The hearing aid according to claim 12, wherein said frame halves each has a collar structure and one of said bridging conductors is disposed on said collar structure of one of said two frame halves that extends over an entire width of said frame as far as a lateral surface of the other of said two frame halves, with said bridging conductors being soldered on said lateral surface of the other of said frame halves.

14. The hearing aid according to claim 1, wherein said frame is produced from a non-conductive material that has a higher permittivity than a material of said housing.

* * * * *